United States Patent [19]

Barroero et al.

[11] 4,223,482

[45] Sep. 23, 1980

[54] REFRIGERATOR DOOR STRUCTURE

[76] Inventors: Louis F. Barroero, 1585 Daniels Dr., San Leandro; Socrates Dekas, 2631 School St., Oakland, both of Calif.

[21] Appl. No.: 869,519

[22] Filed: Jan. 16, 1978

[51] Int. Cl.[2] ..... E05F 1/10

[52] U.S. Cl. ..... 49/386; 49/70; 49/402; 49/501; 49/504; 16/75; 312/138 R

[58] Field of Search ..... 49/70, 501, 504, 402, 49/386, 371, 380, 382; 312/138, 236, 111, 214; 16/75

[56] References Cited

U.S. PATENT DOCUMENTS

| | | | |
|---|---|---|---|
| 1,099,415 | 6/1914 | Winslow | 49/371 X |
| 2,019,526 | 11/1935 | Ellison | 49/386 X |
| 3,254,452 | 6/1966 | Constantini et al. | 49/386 |
| 3,403,953 | 10/1968 | Clark | 49/501 X |
| 3,510,986 | 5/1970 | Berkowitz | 49/386 |
| 3,629,972 | 12/1971 | Rehberg et al. | 49/70 |
| 3,631,630 | 1/1972 | Buffington et al. | 49/402 |
| 3,673,735 | 7/1972 | Winsler et al. | 49/478 X |

*Primary Examiner*—Kenneth Downey
*Attorney, Agent, or Firm*—Phillips, Moore, Weissenberger, Lempio & Majestic

[57] ABSTRACT

A refrigerator door structure comprising a door hingedly mounted on a mullion is disclosed, one or more of which may be mounted in a suitable opening through the wall of a refrigerator compartment without a frame and with or without a starter mullion to close such opening while providing access therethrough. The door and mullion are designed to be inverted to provide for either right-hand or left-hand opening of the door. The packaging of the door structure with appropriate shelving elements is described.

16 Claims, 23 Drawing Figures

120
58
46
47
126
112
72
60
100
52
22
20
74
116
23
36
54
22
52
48
114
100
60'
72
16
58
17
12
57
56a
55

96
104
78
108
102
92
98
102
56

REFRIGERATOR DOOR STRUCTURE

BACKGROUND OF THE INVENTION

This invention relates to commercial refrigerator doors of the general type used to provide access to the interior of built-in refrigerator compartments of the kind used in grocery stores, for example, and more particularly to a refrigerator door structure which may be individually constructed, packaged, shipped and installed.

Commercial refrigerator doors of this type generally comprise glass panels mounted in metal frames for use in connection with refrigerated display facilities which may be built-in in large grocery stores or supermarkets or may be self-contained refrigerator cabinets. Appropriate shelving is generally provided behind the glass panel refrigerator doors on which goods such as milk, cold drinks, perishable goods or frozen foods, for example, may be displayed for sale. The customer selects the goods desired by looking through the glass panel of the door, and removing the goods from the refrigerator. A closure means is generally provided biasing the door to its closed position in order to automatically close the door after it has been opened by the customer.

Since the refrigerated compartments on which the refrigerator doors are used are maintained below normal ambient temperature and often below freezing temperature, the doors generally utilize a plurality of spaced panes of glass with dead air spaces therebetween in order to provide thermal insulation. The metal frames containing the glass panels may be provided with electrical heaters to prevent the condensation of moisture or the formation of frost on the frame and in many cases the glass may also be electrically heated.

A number of doors are generally provided in the opening of a refrigerated compartment in order to enable a customer to obtain access to a particular part of the refrigerated compartment where the desired goods are located. This minimizes the loss of cold air when access to the compartment is desired. In addition, depending on the location of the refrigerated compartment, refrigerator doors with either left-hand or right-hand opening action may be desirable for the convenience of the customer.

Since the refrigerator doors have considerable weight, it has been the practice in the prior art to construct metal frames in various sizes dimensioned to fit standardized openings through the wall of refrigerated compartments and to mount a plurality of refrigerator doors on each such frame with the number of doors varying according to the particular requirements. This has complicated the manufacture, packaging, shipping and installation of refrigerator doors.

The openings through refrigerated compartments are of a number of different sizes and the number of doors required for various refrigerated compartments may vary. The necessity to provide both left-hand and right-hand opening of the doors in different installations further complicates the manufacture of units suitable for installation.

Packaging and shipment of a large frame containing a number of refrigerator doors is difficult and the danger of breakage or damage is high due to the size, weight and unusual shape of such package. The number of different sizes of frames with different numbers of doors opening in both the right-hand and left-hand fashion which must be stocked in order to meet demand represents a considerable investment in finished goods.

It is an object of this invention to provide a new and improved refrigerator door structure which may be manufactured, packaged, shipped and installed individually in whatever number is required for a particular opening through the wall of a refrigerated compartment.

It is another object of this invention to provide a new and improved refrigerator door structure which does not require a mounting frame.

It is a further object of this invention to provide a new and improved refrigerator door structure which may be mounted for either left-hand or right-hand opening action.

SUMMARY OF THE INVENTION

According to this invention, a refrigerator door structure is provided for selectively closing a rectangular opening through the wall of a refrigerated compartment bounded by substantially horizontal upper and lower structural members. Such refrigerator door structure comprises a mullion including means at each of its ends for rigidly fixing such ends of the mullion to the upper and lower structural members with the mullion in a substantially vertical position within the opening. A pair of rigid hinge members are fixed to the mullion and project therefrom outwardly of the refrigerator compartment and transversely of the plane defined by the upper and lower structural members of the opening. The hinge members are spaced from each other along the mullion and the projecting portions of the hinge members have passageways formed therethrough along a common axis which is parallel to the mullion. A rectangular door structure is provided with one side extending along the mullion and receiving the projecting end portions of the hinge members within its boundaries. The door has a passageway therein with the axis of such passageway in alignment with the common axis of the passageways through the end portions of the hinge members and such passageway extends continuously from one end of the door and between the spaced hinge members. A torsion rod is received within the passageway in the door from the end thereof and through the passageways of both of the hinge members. The rod is rotatably received in the passageway in the door and also in the passageway through the end of the one of the hinge members which is adjacent the end of the door through which the rod is inserted. The rod is fixedly received against rotation in the passageway of the other of the hinge members and a locking means is provided at the end of the door in order to lock the adjacent portion of the rod against rotation with respect to the door when the rod is received within the passageway in the door and through the passageways of both of the hinge members.

BRIEF DESCRIPTION OF THE DRAWING

The foregoing and other objects and features of this invention will be more fully understood from a reading of the following detailed description in conjunction with the accompanying drawings in which.

DETAILED DESCRIPTION OF PREFERRED EMBODIMENTS

Figure 1:
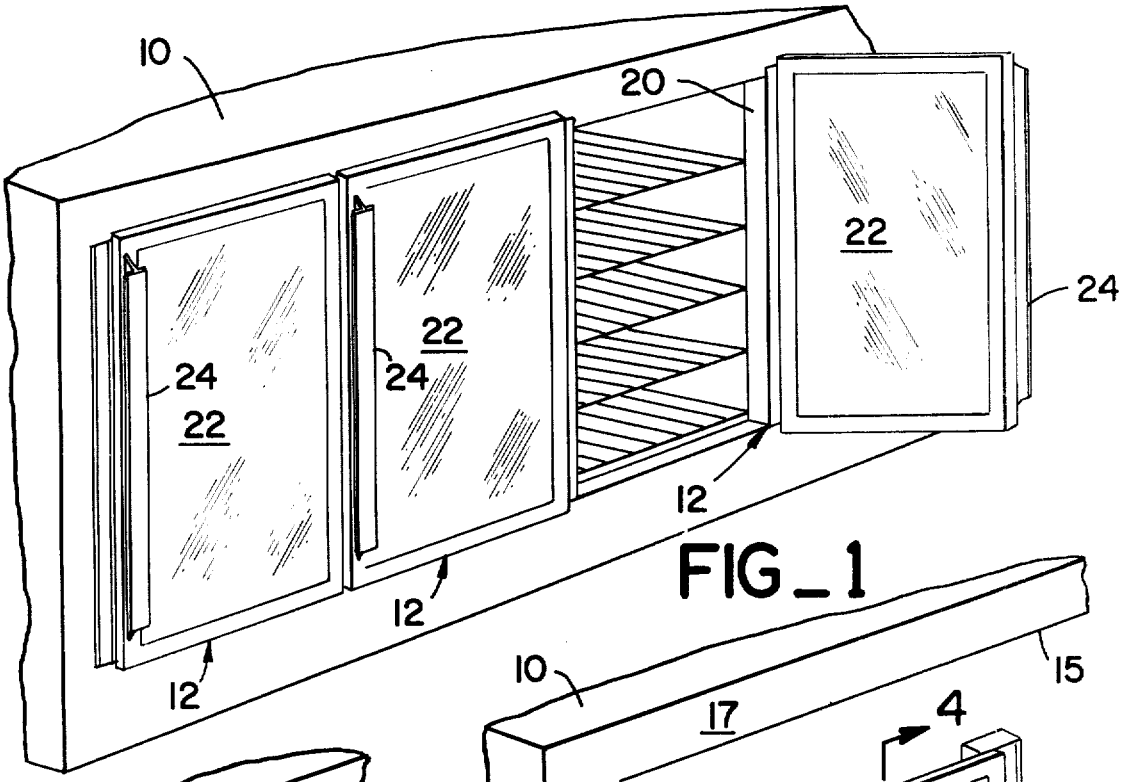
FIG. 1 is a fragmentary perspective view of a refrigerator compartment having a plurality of refrigerator door structures in accordance with this invention mounted in an opening through the wall thereof with one of such doors shown in its open position and the remaining doors shown in their normally closed position.

Referring to FIG. 1, a fragment of a conventional built-in refrigerator compartment is shown in perspective at 10 with a plurality of refrigerator door structures 12 in accordance with the preferred embodiment of this invention shown mounted in a rectangular opening through the wall of such refrigerator compartment 10. The refrigerator compartment 10 may be of the type well known in the art comprising ordinary wall construction which is well insulated with an appropriate refrigeration apparatus communicating with the interior thereof.

Figure 2:
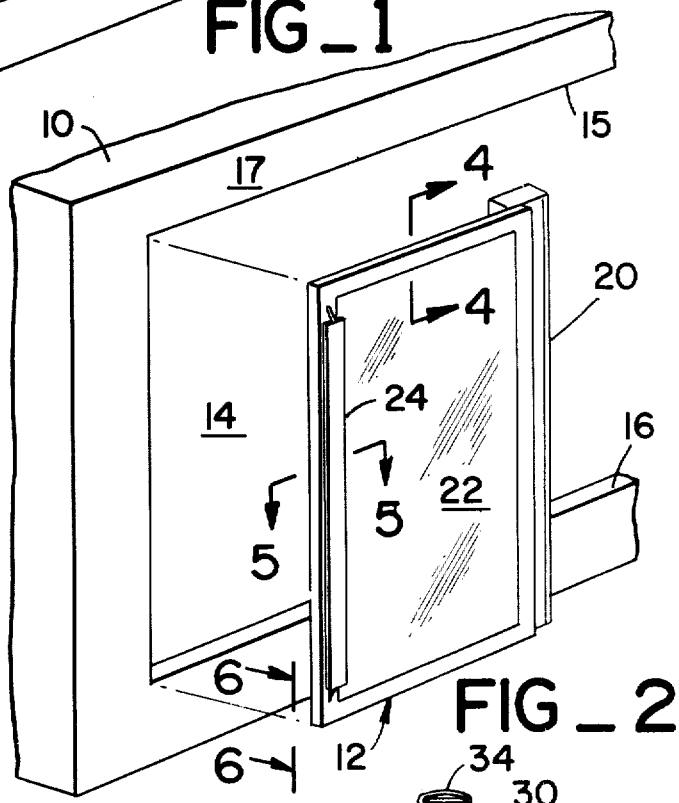
FIG. 2 is an exploded fragmentary perspective view of a refrigerator compartment illustrating the installation of a door structure in accordance with this invention in an opening through the wall thereof without a starter mullion.
Figure 3:
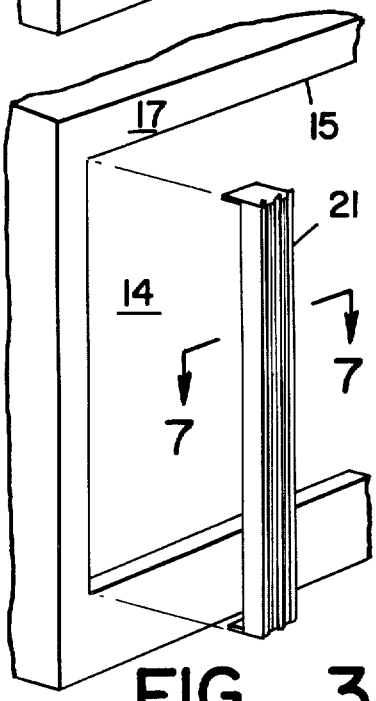
FIG. 3 is an exploded fragmentary perspective view similar to FIG. 2 illustrating the installation of a starter mullion in the opening through the wall of a refrigerator compartment.

As best shown in FIGS. 2 and 3, an opening 14 is provided through a side wall of the refrigerator compartment 10 during construction thereof, which opening has become standardized in the prior art and which conventionally includes upper and lower substantially horizontal structural members which may be, for example, 4"×6" wooden stringers. According to this invention, the structural members bounding the opening 14 must have flat facing surfaces 15 and 16 and the exterior surface 17 of the refrigerator compartment surrounding the opening 14 must be flat. Conventional construction techniques will tend to produce surfaces 15, 16 and 17 having the requisite flatness, although appropriate plastic or metal L-shape or U-shape cross-section moldings may be provided about the periphery of the opening 14, if desired.

The refrigerator door structure 12 according to the teaching of this invention comprises two basic elements namely, a mullion 20 and a door 22 hinged thereto. The mullion 20 has a length slightly less than the spacing between the surfaces 15 and 16 bounding the opening 14 and includes means at its opposite ends to enable it to be rigidly mounted to the surfaces 15 and 16. The door 22 is rectangular and is hinged to the mullion 20 with one of its long sides overlapping the mullion 20. The long sides of the door 22 have a length greater than the spacing between the surfaces 15 and 16 and thus, when the mullion 20 is in place between the surfaces 15 and 16, the other three sides of the rectangular door 22 will tend to overlap the exterior surface 17 of the refrigerator compartment 10.

Referring to FIG. 3, in the preferred embodiment of this invention, a starter mullion 21 is installed at one end of the rectangular opening 14 prior to the installation of the first door for reasons which will be explained more fully hereinafter. As shown in FIGS. 1 and 2, the door structures 12 are installed for right-hand opening and thus the starter mullion 21 is installed at the left-hand end of the rectangular opening 14. If left-hand opening of the door structures 12 is desired, then the starter mullion 21 would be installed at the right-hand end of the rectangular opening 14.

The starter mullion 21 is identical to the mullion 20 of the door structures 12 except that it is not provided with the hinge members of the mullion 20 for the mounting of a door 22 thereon as will be more fully described hereinafter. In the preferred embodiment of this invention, the mullions 20 and 21 are aluminum extrusions designed to receive sealing surface members along the front thereof and a backing member along the rear thereof as will be more fully described below.

Similarly, the preferred embodiment of this invention comprises an array of glass panels mounted in a frame constructed of aluminum extrusions. Referring to FIG. 5, the cross-section of the basic extrusion 23 used in fabricating the frame of the door 22 according to the preferred embodiment of this invention is shown. Such the extrusion 23 is used at the ends of the door 22 and the side thereof adjacent the mullion 20. Referring to FIG. 5, the modified extrusion 23' used at the side of the door 22 opposite the mullion 20 is shown in cross-section. The extrusion 23' differs from the extrusion 23 only in that it includes a handle member 24 extending along the length thereof. As shown in FIG. 5, the handle member 24 is preferably T-shape in cross-section as shown in FIGS. 1 and 2, portions of the handle member 24 may be removed at opposite ends of the extrusion 23' for asethetic reasons or manufacturing considerations. In any event, the handle member 24 would extend symmetrically on opposite sides of the center of he length of the extrusion 23' in the finished door 22 so that the door structure 12 may be inverted to provide either left-hand or right-hand opening thereof. Since the cross-sectional configuration of the extrusions 23 and 23' are the same except for the handle 24, the same reference numerals have been used in both FIGS. 4 and 5 with respect to structural features thereof. Basically the extrusions 23, 23' comprise a generally rectangular body 25 having a flange 26 formed along an edge at one end of the cross-section thereof against which glass panels 27 together with appropriate spacers 28 and sealing means may be removably mounted by a molding member 29 secured to the body 25 by means of screws 30, for example.

An open channel 32 is provided in and extending along the rectangular body 25 at the other end of the cross-section thereof to receive a flexible sealing member 34 which engages the exterior surface 17 of the refrigerator compartment and the portion of the mullion 20 overlapped by the door 22 when the door 22 is in closed position to provide an air-tight seal.

Figure 4:
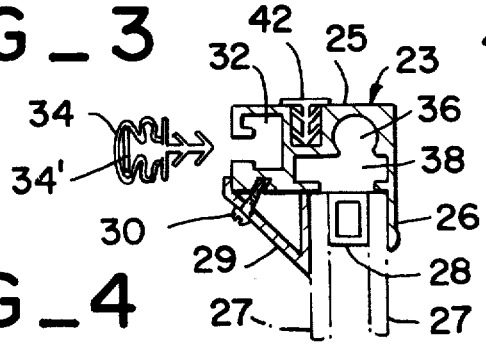
FIG. 4 is an enlarged fragmentary cross-sectional view taken along line 4—4 of FIG. 2 with a sealing element exploded from the frame and showing the glass panels in phantom.
Figure 5:
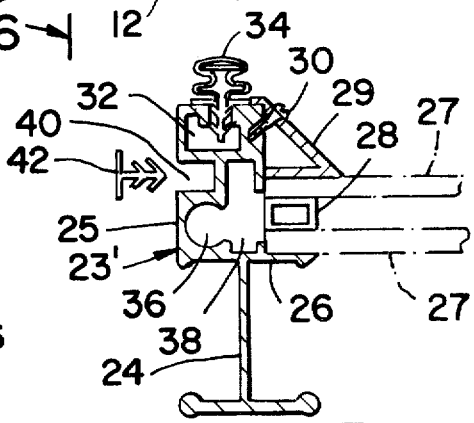
FIG. 5 is an enlarged fragmentary cross-sectional view taken along line 5—5 of FIG. 2 with a filler strip exploded from the metal frame and with the glass panels shown in phantom.

A rectilinear passageway 36 is provided through the interior of the body 25 of the extrusion 23, 23' which passageway 36 is cylindrical in the preferred embodiment shown in FIGS. 4 and 5. The passageway 36 provides for the mounting of the door 22 on the mullion 20 by means of appropriate hinge members and a torsion spring as will be more fully described hereinafter.

The interior of the body 25 of the extrusions 23, 23' is provided with a rectangular passageway 38 adjacent the passageway 36. Such rectangular passageway 38 has an opening through the side thereof to the exterior of the body 25 of the extrusions 23, 23' thus facilitating the fabrication of the extrusion as well as providing for the attachment of lengths of the extrusions 23 and 23' to each other as mitered corners, as will be more fully described hereinafter.

Finally, the extrusions 23, 23' are provided with a groove 40 extending along the side of the cross-section thereof opposite the opening into the passageway 38. Such groove 40 not only reduces the amount of material in the extrusions 23, 23' thereby reducing heat transfer and the cost of the extrusion but also enables the extrusions 23, 23' to be adapted for use in fabricating sliding doors as distinguished from swinging doors. Where the extrusions 23, 23' are used in fabricating the swinging door structures according to this invention, an appropriate strip 42 of plastic, for example, may be inserted in the groove 40 for aesthetic purposes and cleanliness considerations.

Figure 6:
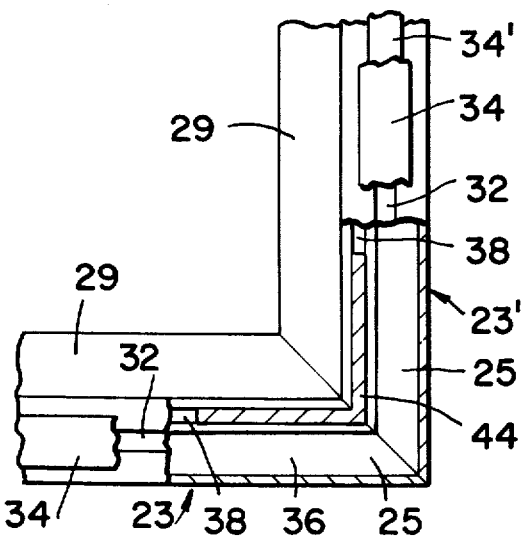
FIG. 6 is an enlarged fragmentary view in elevation of a corner of the refrigerator door taken along line 6—6 of FIG. 2 and partially broken away to show internal structural elements.

Referring to FIG. 6, the extrusions 23, 23' are joined to each other as mitered corners as shown. In FIG. 6, the mitered corner has been broken away to show the L-shaped corner reinforcing bracket 44 received in the rectangular passageway 38 and welded to the body 25 along the open side of the passageway 38 in accordance with the preferred embodiment of this invention. Thus, extrusions 23 and 23' of appropriate length may be rigidly mounted to each other at mitered corners providing for the simple and inexpensive fabrication of frames of any desired dimensions using only two different extrusions.

In FIG. 6, the flexible sealing member 34 is shown received in the channel 32. The flexible sealing member 34 is of a type known in the art fabricated of rubber or appropriate plastic material in a configuration to provide the requisite resilience. In the embodiment shown, a magnetic strip 34' is received within the sealing member 34 in order to cooperate with an appropriate magnetic metal surface which may be provided on the exterior surface 17 of the refrigerator compartment in order to insure air-tight sealing of the member 34 thereagainst.

Figure 7:
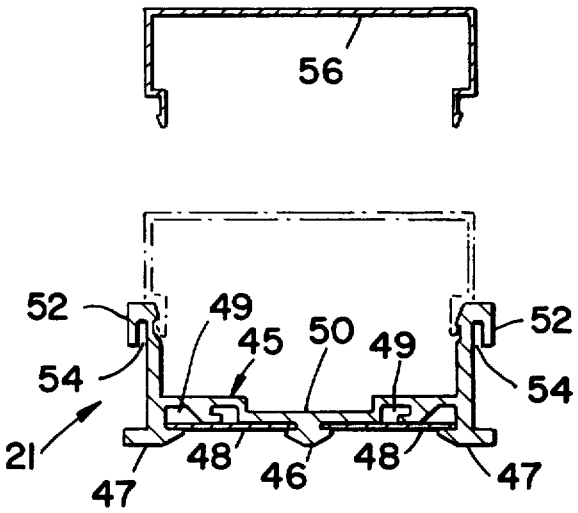
FIG. 7 is an enlarged cross-sectional view of a mullion taken along line 7—7 of FIG. 3 with a removable backing member shown both in phantom and in full as exploded away therefrom.

Referring to FIG. 7, a cross-sectional view of the mullion extrusion 45 taken along line 7—7 of FIG. 3 is shown. The cross-sectional configuration of the mullion extrusion 45 is the same in both the starter mullion 21 of FIG. 3 and the mullion 20 of the door structure 12.

According to the preferred embodiment of this invention, a mullion extrusion 45 is made of aluminum formed as a U-shape channel member having a generally flat bottom. The exterior surface of the flat bottom is provided with a central ridge 46 as well as ridges 47 at each edge thereof. The ridges 46 and 47 are adapted to receive and hold elongated thin strips 48 of appropriate surfacing material along the exterior surface of the bottom of the mullion extrusion 45. The strips 48 provide an appropriate sealing surface to be contacted by the sealing member 34 when the door associated with the mullion is in its closed position. The strips 48 may be made of magnetic metal or other appropriate material, depending upon the particular sealing member 34 which is used. Grooves or channels 49 may be provided in the exterior surface of the flat bottom of the mullion extrusion 45 to receive elongated resistance elements (not shown in FIG. 7) to heat the strips 48 to prevent the formation of frost in low temperature applications for the door structure 12 of this invention.

A central portion of the internal surface of the flat bottom of the mullion extrusion 45 is provided with a mounting groove 50 for the hinge members where the mullion extrusion 45 is to be used in a mullion 20 of a door structure 12 as will be more fully described hereinafter. Similarly, the free ends 52 of the legs of the U-shape mullion extrusion 45 are turned back on themselves to provide external slots 54. As will be more fully explained hereinafter, the free ends 52 of the extrusion 45 are notched into such slots 54 to provide for the support of shelf mounting brackets on the mullion extrusion 45.

Figure 9:
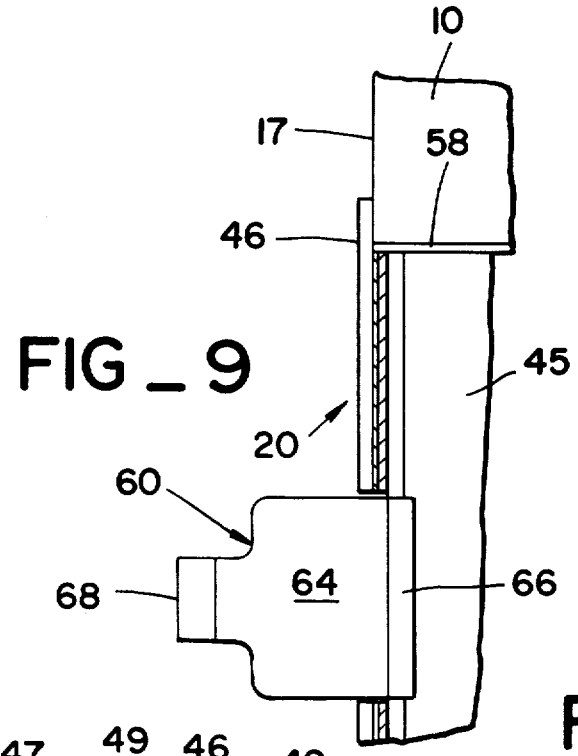
FIG. 9 is a cross-sectional view taken along line 9—9 of FIG. 8.
Figure 8:
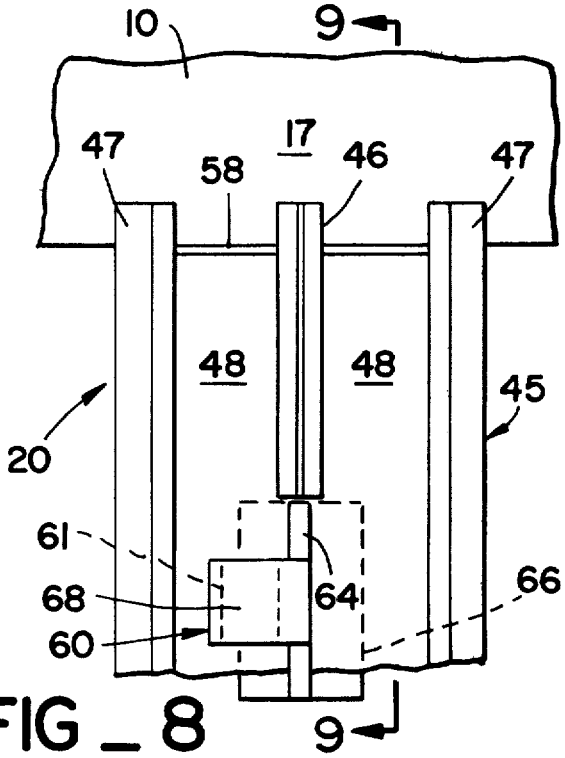
FIG. 8 is a fragmentary view in elevation of the upper end of the mullion of a refrigerator door structure with the door removed to expose the upper hinge thereof.

As shown in FIG. 7, a flexible, generally U-shape snap-on backing member 56 is associated with each mullion extrusion 45. The backing member 56 is adapted to be compressively received between the legs of the mullion extrusion at the free ends thereof. As will be more fully explained hereinafter, the backing member 56 may carry electrical heating and lighting circuitry as desired. Referring to FIGS. 8 and 9, the mullion extrusion 45 is cut to the desired length for mounting within the opening 14 through the side wall of a refrigerator compartment 10. In accordance with the preferred embodiment of this invention, the ends of the desired length of mullion extrusion 45 are machined so that the ridges 46 and 47 project therefrom. An appropriate mounting plate 58 is welded or otherwise rigidly attached to the machined ends of the mullion extrusion 45. Thus the projecting ends of the ridges 46 and 47 provide convenient stops for engaging the exterior surface 17 of the refrigerator compartment 10 facilitating the mounting of the mullion extrusion 45 in the opening 14 with the surfaces of the strips 48 flush with the surface 17.

FIGS. 8 through 11 show the hinge members 60, 60' and the modifications required in the mullion extrusion 45 to produce a mullion 20 to which a door 22 may be hinged to provide a door structure 12 in accordance with the teaching of this invention. In accordance with the preferred embodiment of this invention, two hinge members 60 and 60' are spaced from each other along the mullion 20 so that each is adjacent a different end of the mullion 20. The hinge members 60 and 60' are identical to each other except that one of the hinge members 60 has a smooth cylindrical passageway 61 therethrough, whereas the other hinge member 60' has a passageway therethrough the cross-section of which defines a hexagon or other non-circular figure. Thus, the hinges 60 and 60' according to the preferred embodiment of this invention comprise a flat plate 64 having a mounting base 66 providing mounting flanges extending transversely of plate 64 at one end thereof. The other end of the plate 64 is provided with an integral body 68 which is offset to one side of the plate 64. The passageways 61 and 62 are formed through the offset bodies 68 of the hinge members 60 and 60' so that when such hinge members are mounted on the mullion extrusion 45, the passageways 61 and 62 will have a common axis extending parallel to the mullion 20.

Figure 10:
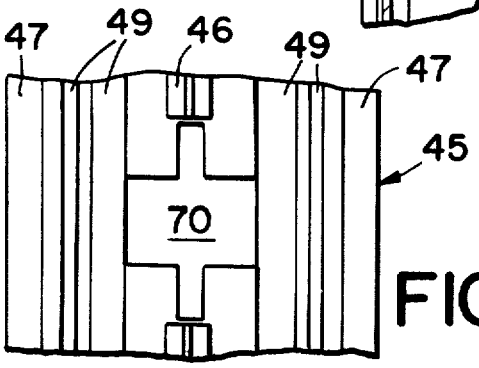
FIG. 10 is a fragmentary view in elevation of a portion of the mullion of FIG. 8 showing the hinge mounting aperture formed therein with the hinge and front sealing panels removed.
Figure 11:
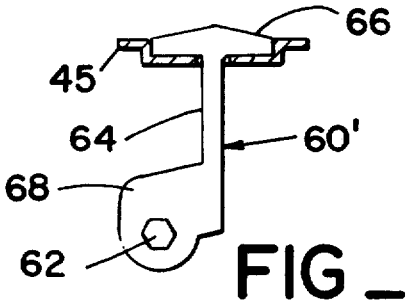
FIG. 11 is a top plan view of the lower one of the pair of hinges with a fragment of the mullion shown in cross-section to illustrate the mounting of the hinges thereon.

Referring to FIG. 10, the hinge members 60 and 60' are mounted on the mullion extrusion 45 by removing a portion of the ridge 46 at the point where the hinge member 60, 60' is to be mounted. A generally cross-shaped aperture 70 is then formed in the mounting groove 50 of the flat bottom of the mullion extrusion 45. The aperture 70 has a first pair of arms extending in alignment with the ridge 46 and a second pair of arms extending transversely thereof. The arms of the aperture 70 extending transversely of the ridge 46 are dimensioned to receive the offset body 68 of the hinge member 60, 60' therethrough whereas the pair of arms of the aperture 70 in alignment with the ridge 46 are dimensioned to receive the plate 64 of the hinge members 60, 60' therethrough. Thus, as best shown in FIG. 11, a hinge member 60, 60' may be passed through the aperture 70 and the flanges provided by the base 66 thereof brought into engagement with the bottom of the mounting groove 50 in the flat bottom of the mullion extrusion 45. The mounting base 66 is then welded or otherwise rigidly affixed to the mullion extrusion 45.

Figure 14:
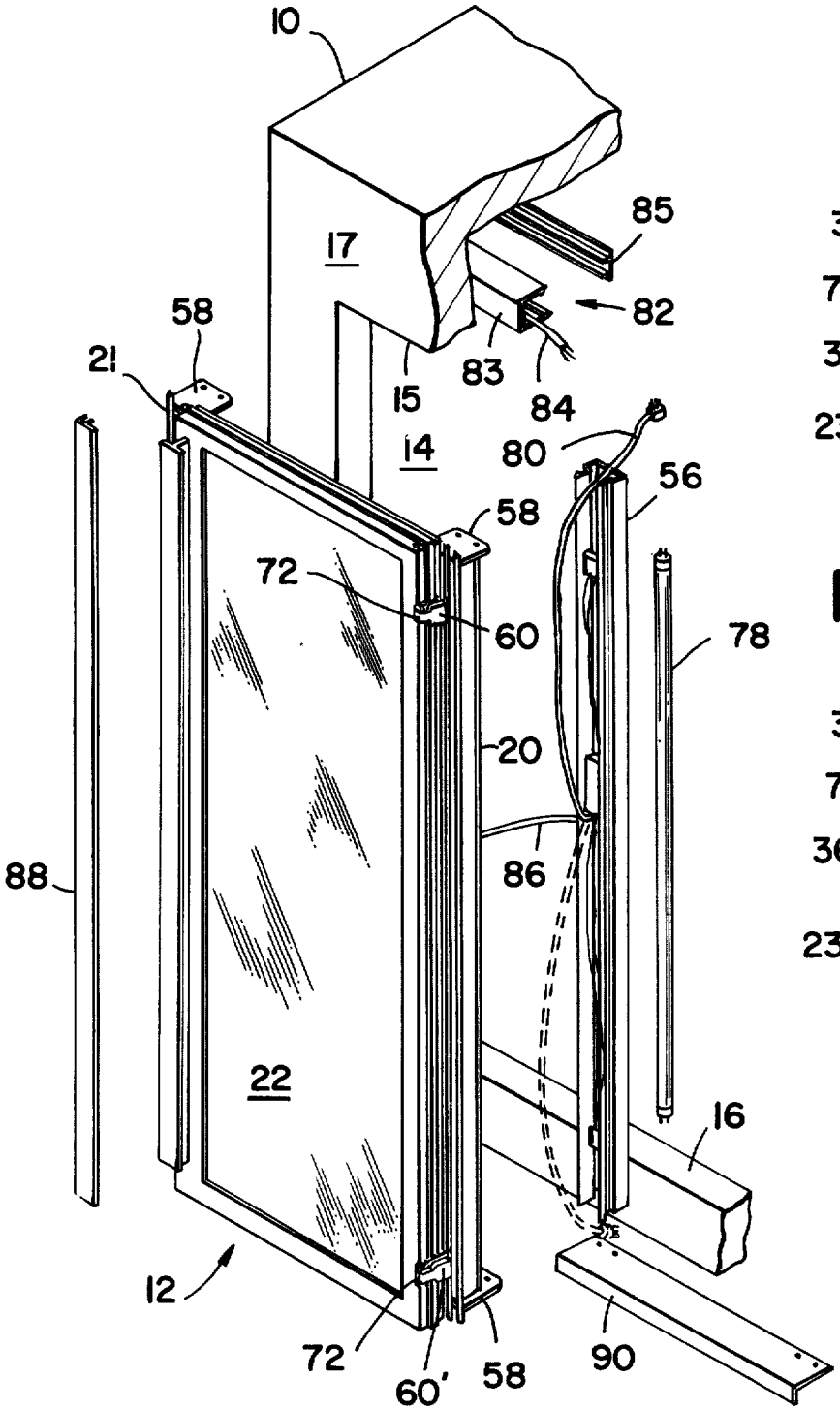
FIG. 14 is an exploded perspective view partially in cross-section illustrating in greater detail the installation of a refrigerator door structure in the opening through the wall of a refrigerator compartment in accordance with this invention.
Figures 18, 18A:
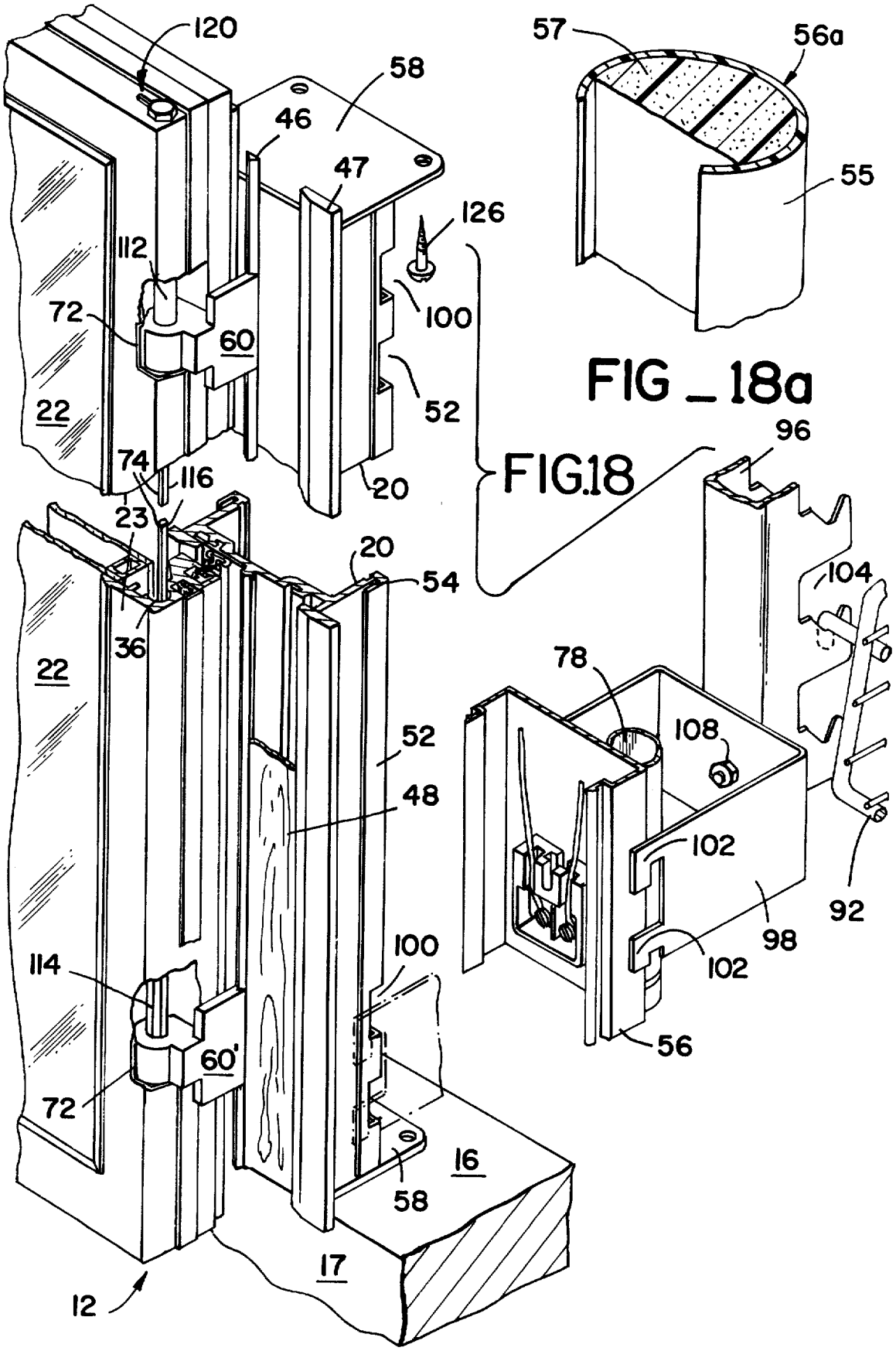
FIG. 18 is a fragmentary perspective view partially broken away to show the mounting of the door on the hinges by means of a torsion rod with the mullion backing member, fluorescent light tube, shelf post support brackets, shelf posts and shelves illustrated in exploded form.
FIG. 18A is a fragmentary perspective view partially in cross-section showing an alternate mullion backing member according to this invention.
Figure 19:
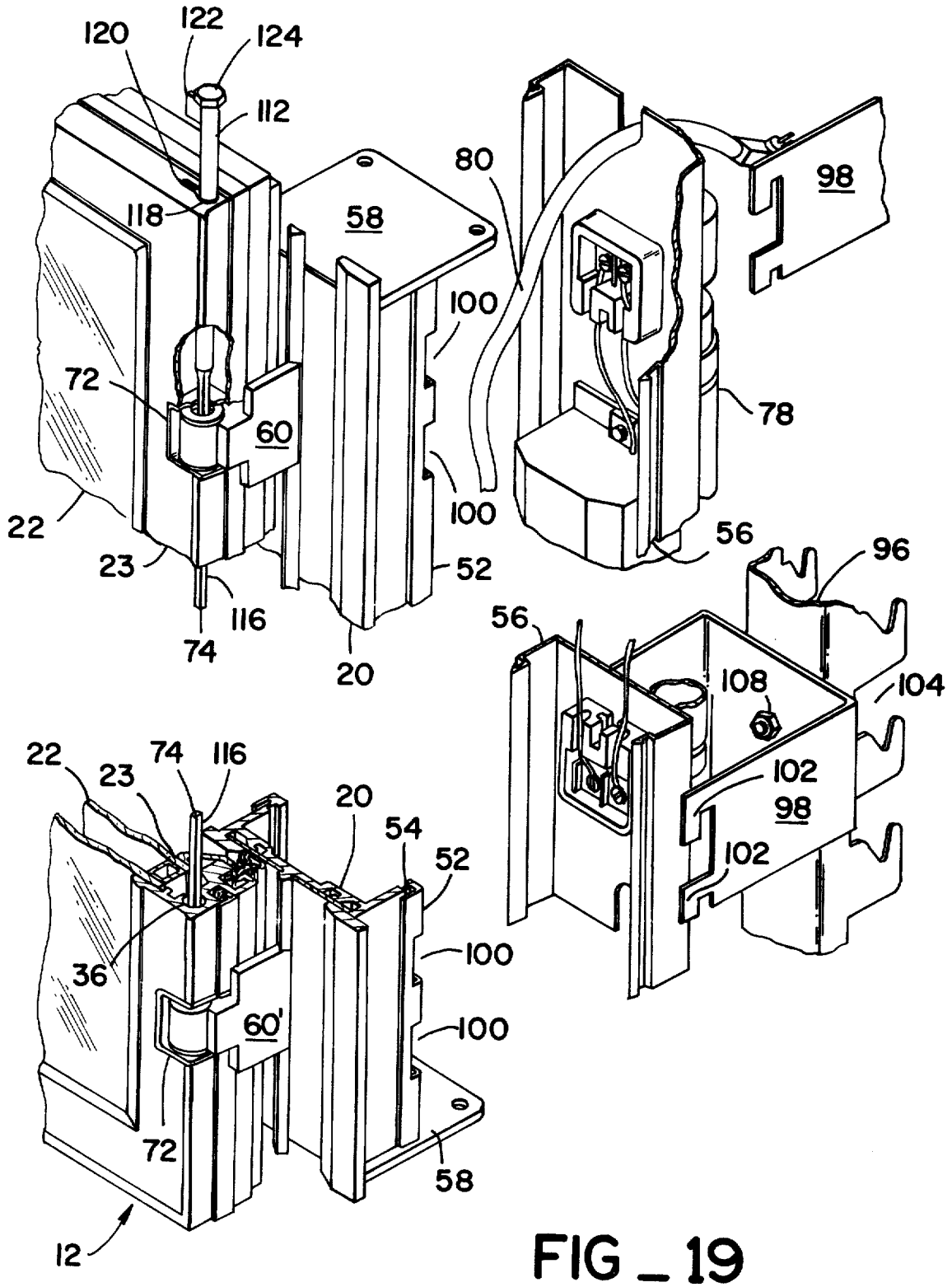
FIG. 19 is a fragmentary perspective view similar to FIG. 18 but showing the torsion rod partially removed from the hinges to illustrate the installation thereof providing sufficient torque in the torsion rod to bias the door to its normally closed position.

As best shown in FIGS. 14, 18 and 19, the door 22 of each door structure 12 is mounted on the mullion 20 thereof by means of the hinge members 60, 60'. Thus, referring to FIGS. 18 and 19, a notch 72 is machined in the external corner of the extrusion 23 which forms the side of the frame of the door 22 which overlaps the mullion 20 at locations corresponding to the locations of the hinge members 60 and 60'. The notches 72 are dimensioned so that the offset bodies 68 of the hinge members 60,60' may be received therewithin with the common axes of the passageways 61 and 62 thereof in coaxial alignment with the passageway 36 formed in the interior of the extrusion 23 as described hereinabove. As will be more fully described hereinafter, a torsion rod 74 is received in the passageway 36 of the extrusion 23 passing through the passageway 61 and 62 of the hinge members 60 and 60' thereby supporting the door 22 for rotation on the hinge members 60, 60'.

Figure 12:
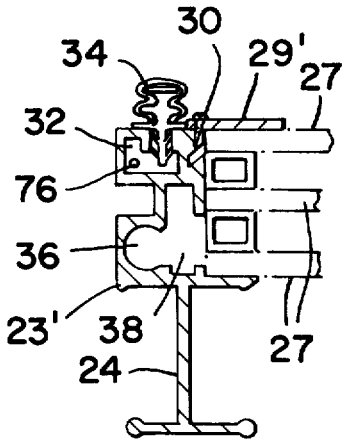
FIG. 12 is a fragmentary cross-sectional view similar to FIG. 5 but showing an embodiment of the door including three spaced glass panels.
Figure 13:
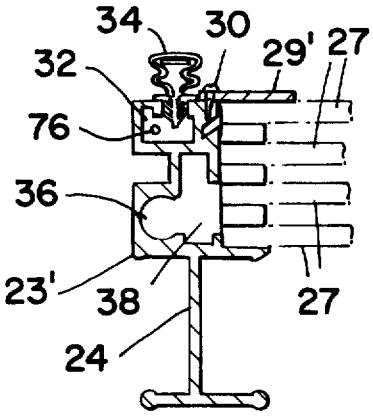
FIG. 13 is a cross-sectional view similar to FIG. 12 but showing an embodiment of the refrigerator door including four spaced glass panels.

Referring to FIGS. 12 and 13, it may be necessary in extremely low temperature applications for the refrigerator door structure of this invention to provide for greater thermal insulation. Thus, by substituting a flat molding member 29' for the molding member 29 shown in FIGS. 4 and 5, it is possible to mount either three spaced panes of glass 27 as shown in FIG. 12, or four spaced panes of glass 27 as shown in FIG. 13 in the frame formed by extrusions 23, 23' as described hereinabove. In addition, an appropriate electrical heating element 76 such as a resistance wire may be placed in the open channel 32 of the extrusions 23, 23' in order to prevent the formation of frost at the sealing element 34. In certain applications it may also be necessary to heat the glass panes 27 to prevent fogging as by means of providing an electrical resistance coating on the glass panes. In any event, it may be desirable to provide an electrical connection between the mullion 20 and the door 22 of the door structure 12.

Figure 16:
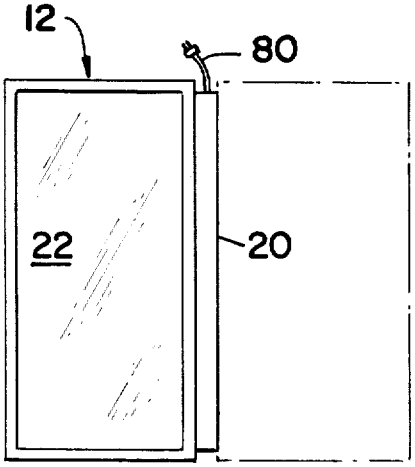
FIGS. 16 and 17 illustrate that a refrigerator door structure in accordance with the teaching of this invention may be simply inverted end-for-end to provide either left-hand or right-hand opening of the door.
Figure 17:
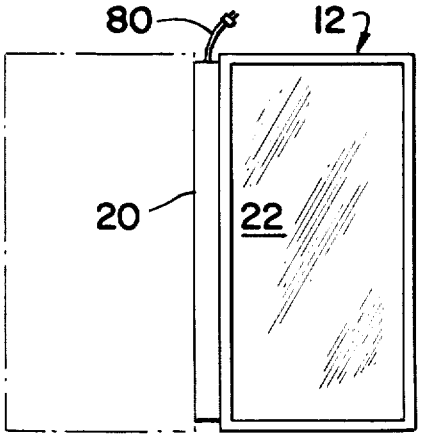

Referring to FIG. 14, an exploded view of the preferred embodiment of this invention is shown in greater detail. Thus, in FIG. 14, the mullion backing member 56 is shown together with appropriate electrical connections for mounting and energizing a light source in the form of a fluorescent tube 78 thereon. As shown in FIG. 14, an elongated electrical connection cord 80 extends within the backing member 56 from about the middle thereof beyond the end thereof. In a typical installation, an electrical conduit means 82 comprising a channel mounting member 83 containing an electrical supply line 84 and appropriate sockets (not shown in FIG. 14) with a closure plate 85, will be mounted along the upper boundary of the opening 14 through the wall of the refrigerator compartment 10. Thus the electrical connection cord 80 may be removably connected to the electrical conduit means to provide power for the fluorescent tube 78 light source. In addition, an electrical connection cord 86 may extend between the backing member 56 and the door 22 or mullion 20 in order to provide electrical power for heating elements located therein. As indicated by the dotted lines in FIG. 14, the electrical connection cord 80 may be caused to project from either end of the backing member 56. Thus, referring to FIGS. 16 and 17, the door structure 12 according to this invention may be mounted for either left-hand or right-hand swinging operation without disturbing the electrical connections thereto. The backing member 56 is simply unsnapped from the mullion and the electrical connection cord 80 moved so that it projects from the proper end of the backing member 56. The backing member 56 is then remounted on the mullion and the entire door structure is inverted so that the electrical connection cord 80 projects from the top thereof for connection to the electrical supply conduit means.

As shown in FIG. 14, a starter mullion 21 is used in accordance with the preferred embodiment of this invention. As also shown in FIG. 14, an outer box trim member 88 may be used for aesthetic or other purposes as desired in conjunction with the starter mullion. Also, as shown in FIG. 14, a jig template 90 may be used in connection with the installation of a plurality of door structures 12 in a given opening 14 through the wall of a refrigerator compartment. Thus, the template 90 may be used to mark the appropriate location and spacing of mounting holes at which the mounting plates 58 of the mullions 20 and 21 will be affixed to the surfaces 15 and 16 of the opening 14.

Referring to FIG. 18A, an alternate mullion backing member 56A is shown which is particularly adapted for use in low temperature applications for the door structure of this invention. Alternate backing member 56A comprises a shell 55 made of material having low thermal conduction characteristics and a filling 57 of thermal insulating material. For example, the shell 55 may comprise an elongated section of low heat conducting plastic tubing defining an arc in cross-section and having sufficient resilience and appropriate dimensions so that the free ends of the legs of the arcuate cross-section thereof may compressively receive therebetween the free ends 52 of the legs of the mullion extrusion 45. The filling 57 may comprise styrofoam, for example, providing heat insulating properties and being sufficiently resilient so that it may be mounted in the shell 55 prior to installation of the alternate backing member 56A on the mullions 20 and 21. Alternatively, the filling 57 may be provided in the shell 55 after it has been installed on the mullions 20 and 21 as by filling the shell 55 in situ with a foaming plastic material known in the art having good thermal insulating properties. In either event, the shell 55 may support appropriate electrical circuitry and connections as described hereinabove with respect to the backing member 56. Thus, the alternate backing member 56A will tend to insulate the mullions 20 and 21 from the low temperature to which they would otherwise be exposed and will tend to reduce the energy requirements for maintaining such low temperature as well as tending to reduce the formation of frost and condensation of moisture on the mullions 20 and 21.

Figure 15:
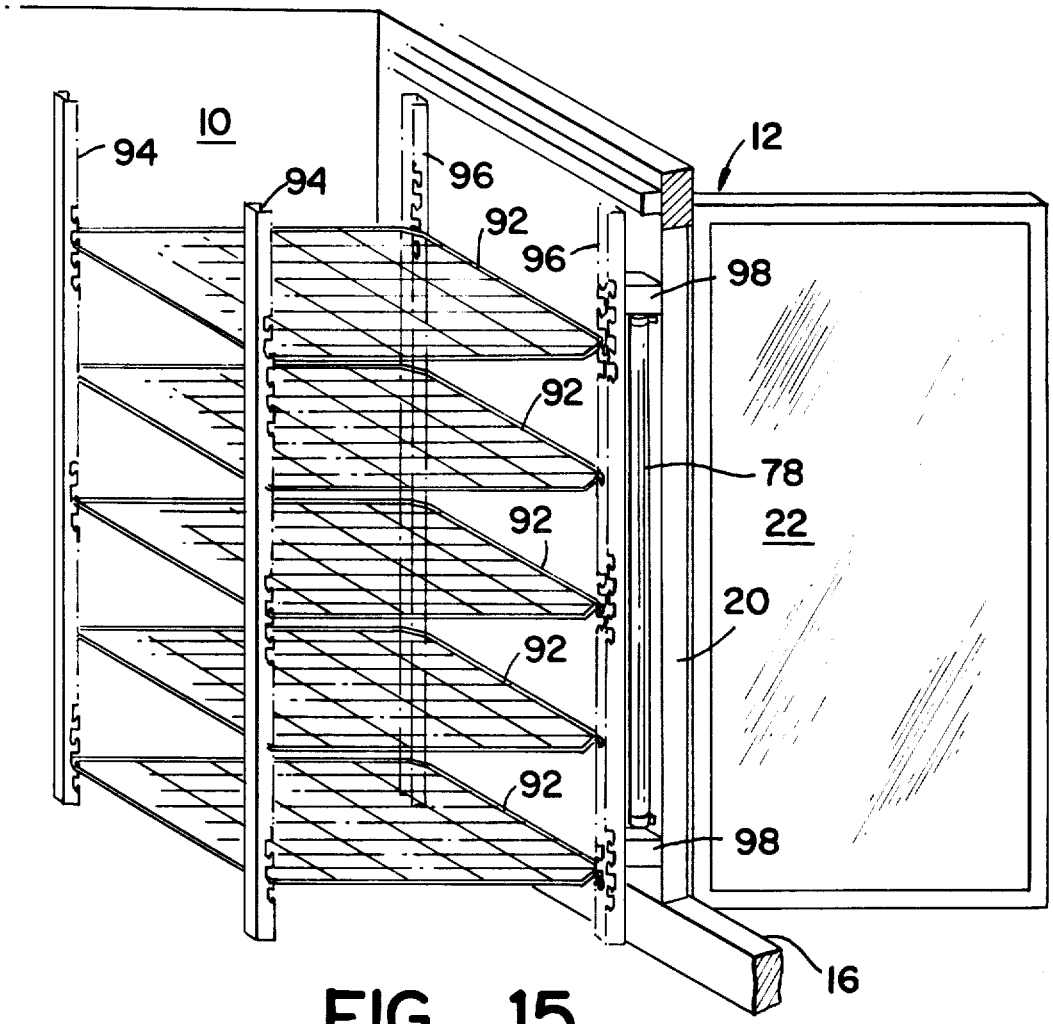
FIG. 15 is a perspective view partially in cross-section taken from the interior of a refrigerator compartment illustrating the shelf structure in accordance with the teaching of this invention.

Referring to FIG. 15 which is a perspective view taken from the interior of the refrigerator compartment, in the preferred embodiment of this invention a plurality of shelves 92 are associated with each door structure 12. The shelves 92 are supported by means of a pair of free-standing posts 94 and a pair of captive posts 96 each of which is attached to the mullion 20 of a different door structure 12 by means of a pair of post mounting brackets 98. A captive shelf support post is also mounted on the starter mullion 21 by a pair of post mounting brackets 98 and a free-standing shelf support post is associated therewith. Thus, a set of shelves 92 may be provided for each door structure 12 in order to support goods within the refrigerator compartment for easy access by a customer through the door structure 12.

Referring to FIG. 18, the post mounting brackets 98 are U-shaped members dimensioned to receive the backing members 56 of the mullions 20, 21 between the legs thereof. The free ends 52 of the legs of the U-shape cross-section of the mullions 20, 21 are provided with notches 100 at opposite ends of the mullions and the free ends of the legs of the post mounting brackets 98 are provided with hook means 102 adapted to be received through the notches 100 to engage the slots 54 provided at the free ends 52 of the legs of the channel shape mullion extrusion 45 as described hereinabove.

Figure 20:
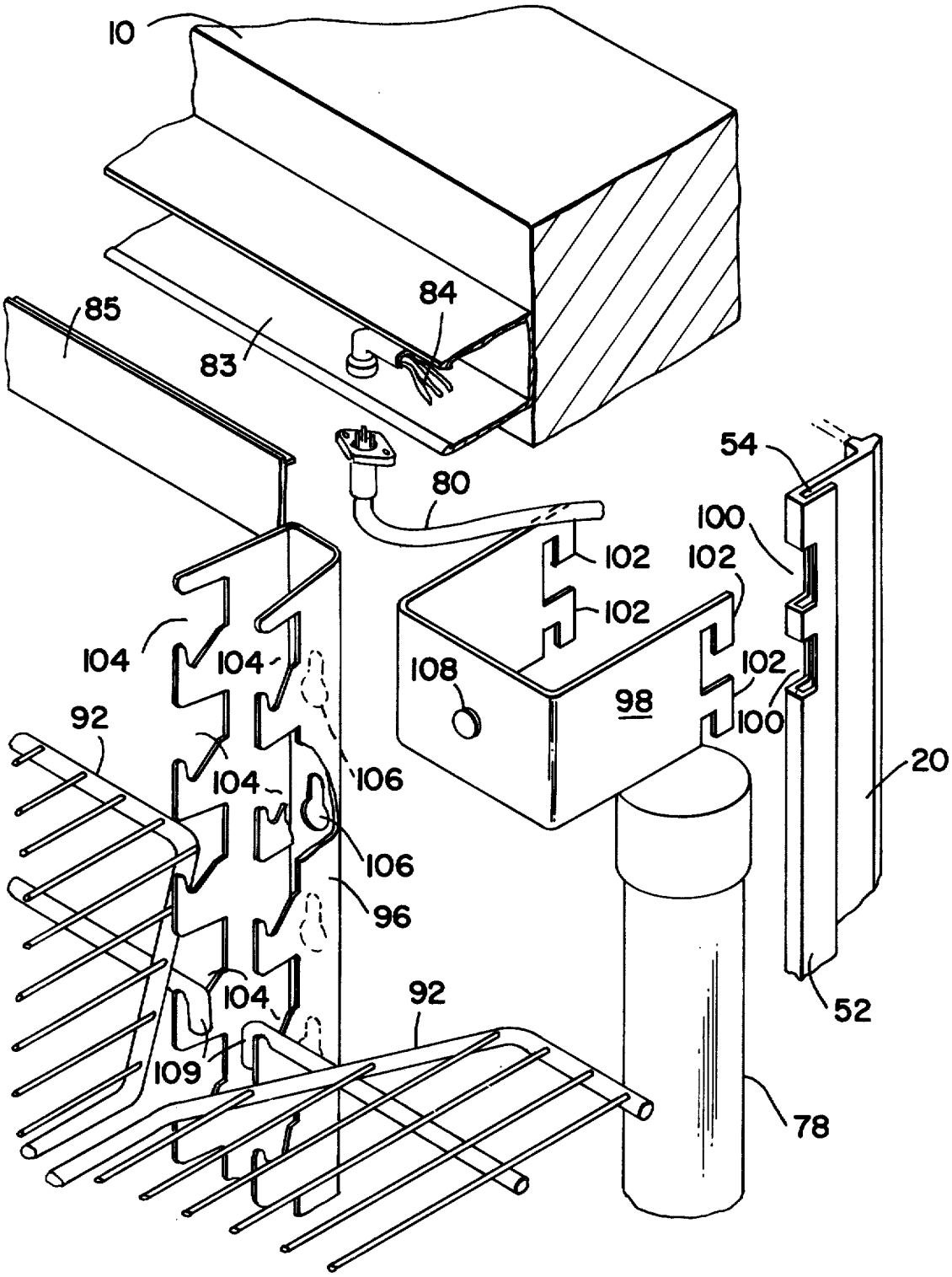
FIG. 20 is a fragmentary exploded perspective view partly in cross-section taken from the interior of a refrigerator compartment to show the interrelation between structural elements of the preferred embodiment of this invention, including shelving structure.

As best shown in FIG. 20, the captive shelf support posts 96 may conveniently comprise channel members having shelf support notches 104 formed in the free ends of the legs thereof and post support slots 106 distributed along the bottom thereof. The post support slots are adapted to engage lugs 108 projecting from the bottom of the brackets 98. The shelves 92 may be of conventional wire construction including mounting hooks 109 projecting therefrom for engagement with the notches 104 in the post 96. The free standing posts 94 may be made identical to the captive post 96. Thus, according to this invention a shelf structure is provided in conjunction with each door structure 12 which shelf structure may be quickly and easily assembled with a high degree of flexibility in the shelf location and spacing.

Referring again to FIGS. 18 and 19, the torsion rod 74 which cooperates with the hinge members 60 and 60' in mounting the door 22 of each door structure 12 on the mullion 20 thereof not only serves as a hinge pin but also provides a spring action for automatic closure of the door 22. To this end, the torsion rod 74 is provided with a right circular cylindrical shank 112 at one end thereof and with a non-circular shank 114 at the other end thereof. The passageway 61 through the hinge member 60 is dimensioned to have the same diameter as the passageway 36 formed in the body 25 of the extrusion 23 and the right circular cylindrical shank of the torsion rod 74 is dimensioned to be rotatably received in the passageways 36 and 61 with a close tolerance. Similarly, the hexagonal or other non-circular passageway 62 through the second hinge member 60' has maximum dimensions equal to the diameter of the passageway 36 in the extrusion 23 and the non-circular shank 114 on the torsion rod 74 has a hexagonal or other non-circular cross-section dimensioned to be received in the passageway 62 of the hinge member 60' with a snug fit. The shanks 112 and 114 of the torsion rod 74 are of sufficient length to extend on both sides of the passageways 61 and 62 in the hinge members 60 and 60', respectively, when the torsion rod is in place thereby engaging the passageway 36 in the extrusion 23 on both sides of both hinge members 60 and 60' to provide a hinge pin function as shown in FIG. 18.

The portion 116 of the torsion rod 74 intermediate the shanks 112 and 114 has smaller cross-sectional dimensions than the shanks 112 and 114 and the torsion rod 74 is made of appropriate material so that it can resiliently receive and store internal forces exerting a torque on the door 22 to bias the door to its normally closed position. As best showin FIG. 19, the end of the door 22 adjacent the hinge member 60 is provided with an opening 118 in the frame thereof communicating with the passageway 36 in the extrusion 23 forming the side of the door 22 which overlaps the mullion 20. In mounting the door 22 on the mullion 20, the door 22 is positioned so that the offset bodies 68 of the hinge members 60 and 60' are received in the notches 72 of the door 22 with the passageways 61 and 62, respectively, of the hinge members 60 and 60' in coaxial alignment with the passageway 36 in the extrusion 23. The end of the torsion rod 74 bearing the non-circular shank 114 is then inserted in the opening 118 and passed through the passageway 36 in the extrusion and the passageway 61 in the first hinge member 60. The insertion of the torsion rod 74 is continued until the non-circular shank 114 thereof is received in the non-circular passageway 62 of the hinge member 60' and the right circular cylindrical shank 112 of the torsion rod 74 is received through the circular passageway 61 of the hinge member 60.

As best shown in FIG. 19, the end of the door 22 through which the torsion rod is inserted is provided with a locking means to prevent rotation of the associated end of the fully installed torsion rod 74 with respect to the door 22 which locking means may be in the form of a keyway 120 which cooperates with a key member 122 formed at the end of the torsion rod 74 adjacent the right circular cylindrical shank 112. The torsion rod 74 may also be provided with a head 124 adjacent the key member 122 to facilitate installation of the torsion rod 74.

Thus, as shown in FIG. 19, the non-circular passageway in the hinge member 60' and the non-circular shank 114 of the torsion rod 74 are adapted to enter into mating engagement with the key member 122 of the torsion rod 74 rotated out of alignment with the keyway 120 in the door in a clockwise direction. An appropriate tool is then applied to the head 124 of the torsion rod 74 to twist the torsion rod in a counterclockwise direction to bring the key member 122 of the torsion rod 74 into locking engagement with the keyway 120 formed in the door. Such twisting of the torsion rod 74 will induce internal stresses therein so that, when the key member 122 of the torsion rod is in locking engagement with the keyway 120 in the door, a torque will be applied to the door biasing the door toward its closed position. Opening of the door will induce further internal stresses in the torsion rod 74 tending to cause the door 22 to automatically return to its closed position with respect to the mullion 20. The frictional forces between the passageway 62 in the hinge member 60' and the frictional forces between the key member 122 and the keyway 120 due to the internal stresses in the torsion rod 74 and the resultant torque will bind the torsion rod firmly in place once it has been installed, as described above. Thus the door structure 12 may be mounted either in the position shown in FIGS. 18 and 19 or in an inverted position without danger of the torsion rod being displaced by gravity and in fact, once the torsion rod 74 has been installed, it can only be removed by driving it out of the door to disengage the locking engagement of the key 122 and keyway 120.

From the above description it will be seen that the teaching of this invention enables a plurality of door structures 12 to be constructed for installation in a given opening through the side wall of a refrigerator compartment. Each door structure 12 includes a door 22 hinged to a mullion 20 and spring biased to its normally closed position. Each mullion 20 provides a sealing surface both for the door hinged thereto and for the door 22 of an adjacent door structure 12. The door structures 12 may be individually and conveniently mounted in the opening through the wall of the refrigerator compartment by means of the mounting plates 58 and appropriate fasteners which may take the form of screws 126, for example (see FIG. 18). The door structures 12 may include electrical connections for lighting the interior of the refrigerator compartment and for heating the door structure as necessary and desirable. The door structures 12 may be mounted for either left-hand opening or right-hand opening without modification thereof and without interfering with electrical connections thereto. In the preferred embodiment of this invention, each of the door structures 12 has a plurality of shelves associated therewith which may be quickly and easily assembled to each of the door structures 12 after installation thereof for either right-hand opening or left-hand opening.

Figure 21:
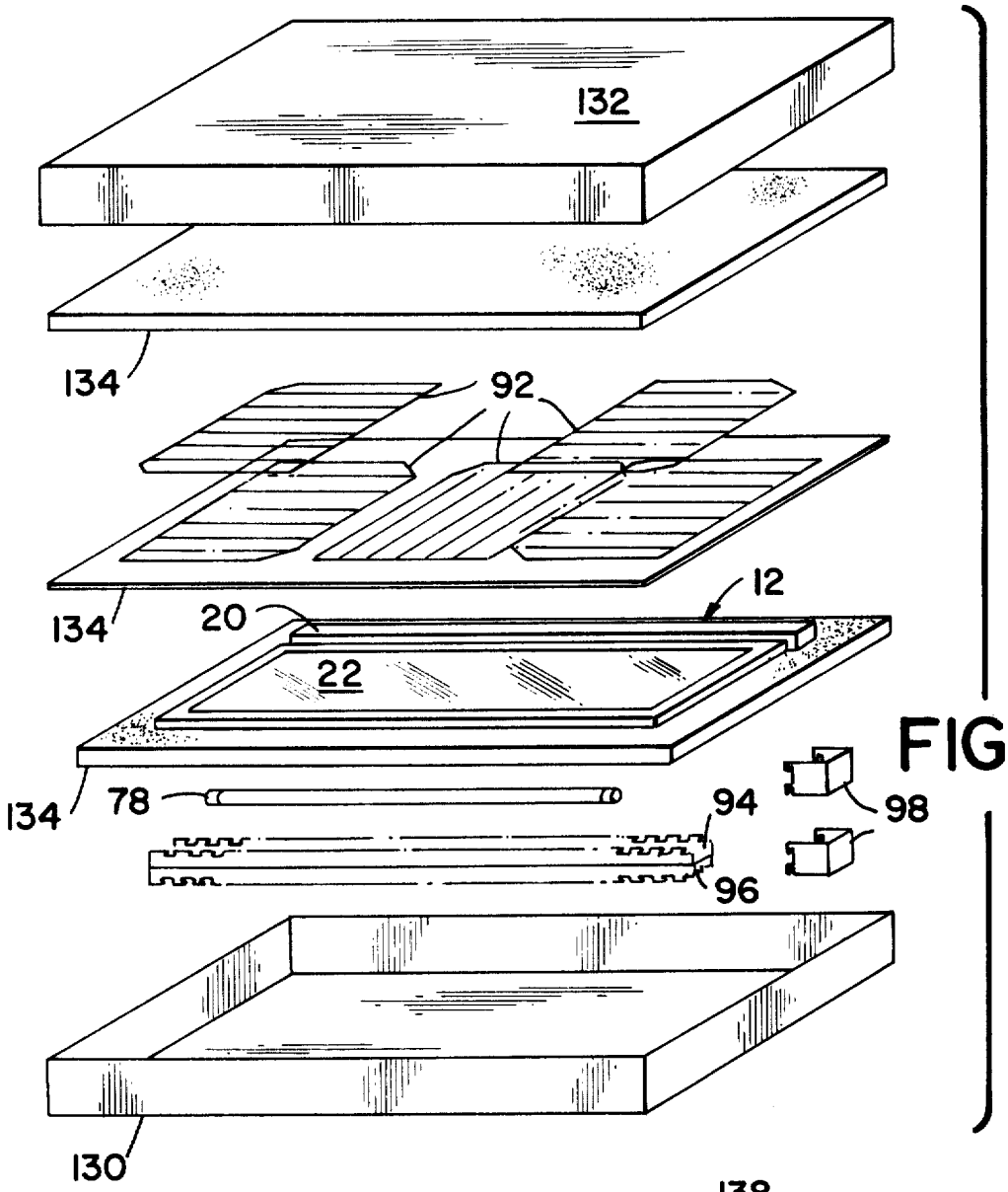
FIG. 21 is an exploded view illustrating a packaging system for a refrigerator door structure in accordance with the preferred embodiment of this invention including shelving structure.
Figure 22:
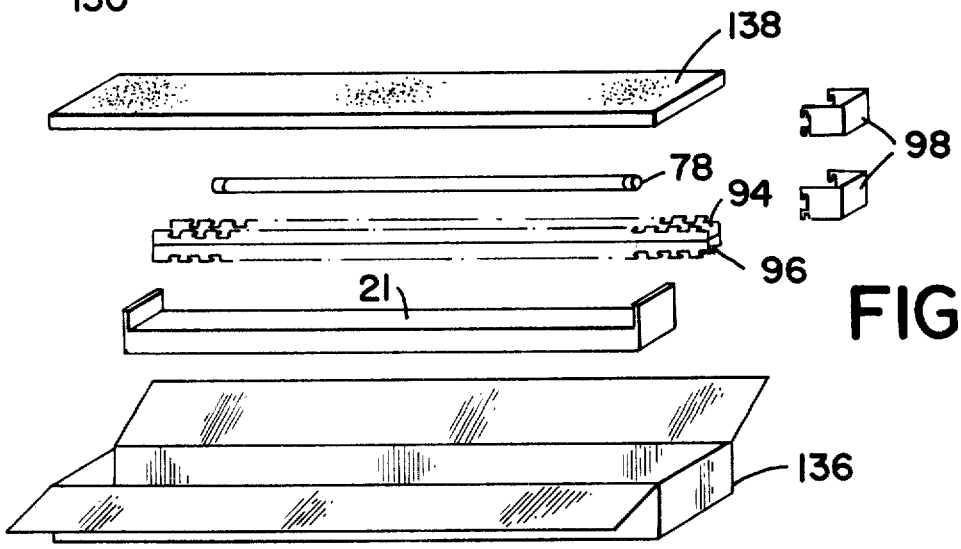
FIG. 22 is an exploded perspective view illustrating a packaging system for a starter mullion in accordance with the preferred embodiment of this invention including shelving structure.

Referring to FIGS. 21 and 22, door structures in accordance with the teaching of this invention may be easily and conveniently packaged for individual shipment and installation. Thus, as shown in FIG. 21, a fully assembled door structure 12 together with all other appurtenances associated therewith in the preferred embodiment of this invention may be packaged in a carton only slightly larger than the door structure 12 comprising a box 130 and lid 132 with appropriate layers of packing material which may be in the form of styrofoam sheets, for example. As shown in FIG. 21, a preassembled door structure 12 consisting of the door 22 and mullion 20 may be placed between styrofoam sheets 134. A pair of shelf supporting posts 94 and 96 together with a pair of post mounting brackets 98 and a set of shelves 92 as well as a fluorescent tube 78, may be contained in the package between appropriate layers of packing material 134, thus producing a self-contained unit which may be individually shipped to the customer for installation with reduced problems in handling or likelihood of damage.

Referring to FIG. 22, the packaging of an individual starter mullion 21 in a carton 136 is illustrated. The preassembled starter mullion 21 is placed in the carton 136 together with a pair of shelf support posts 94, 96, a pair of post mounting brackets 98 and a fluorescent tube 78. Appropriate packing material which may be in the form of styrofoam sheets is indicated at 138.

Since the spacing between the upper and lower horizontal members of the openings through the side walls of refrigerated compartments have become standardized in a few sizes with the horizontal length of the opening varying as required, it is possible to fabricate and stock door structures according to the teaching of this invention in only a few sizes in order to supply the demand. The number of door structures required in various applications may vary widely, but since the door structures according to this invention may be mounted for either left-hand or right-hand opening and since it is unnecessary to mount door structures according to the teaching of this invention in a frame prior to installation, the cost of maintaining a sufficient inventory of finished door structures to supply customer demand is greatly reduced. The danger of breakage in shipment to remote customers is also greatly reduced according to the teaching of this invention since the door structures are individually packaged and shipped for individual installation. The basic door structure 12 need not be modified for use in applications involving temperatures below freezing but instead, the door structure 12 of this invention may be easily adapted for such applications by including additional features therein.

Where shelving is desired in association with the door structure, the separate packaging and shipment of a starter mullion for individual installation is convenient and inexpensive.

It is anticipated that those skilled in the art will find many and varied applications for door structures according to the teaching of this invention. For example, many large supermarkets now employ open front type refrigerated display cases which are wasteful of energy in that the constant escape of cooled air through the open front of such display cases requires a constant supply of cold air to maintain the desired temperature in the display case. Such open front display cases may be easily adapted for the mounting of door structures according to the teaching of this invention with a consequent saving in energy required to maintain the desired low temperature within such display cases.

Furthermore, the mullions may be omitted from the door structure according to this invention, and the hinges adapted for mounting on an existing mullion or frame. In other words, hinges 60, 60' as described above may be mounted on the door 22 by means of the torsion rod 74 as described above. The mounting base 66 of the hinges may be adapted for mounting to an existing mullion as by providing it with screw holes, for example, or other appropriate means. Thus, the subcombination of the door 22, hinges 60, 60' and torsion rod 74 may also embody the subject invention.

Thus, it is believed that door structures according to the teaching of this invention will be adapted for many and varied applications without departing from the scope of the following claims.

What is claimed is:

1. A refrigerator door structure for selectively closing a rectangular opening through the wall of a refrigerated compartment bounded by substantially horizontal upper and lower structural members spaced from each other a given vertical distance, said refrigerator door structure comprising:

a. a mullion having a length slightly less than said given vertical distance and mounting means at each of its ends for rigidly fixing said ends of said mullion to said upper and lower structural members with said mullion in a substantially vertical position within said opening;

b. a pair of rigid hinge members fixed to said mullion and projecting therefrom outwardly of said refrigerator compartment and transversely of the plane defined by said upper and lower structural members, said hinge members being spaced from each other along said mullion and the projecting end portion of each thereof having a passageway formed therethrough along a common axis parallel to said mullion;

c. a rectangular door having sides of greater length than said given vertical distance with one side extending overlappingly along said mullion in alignment therewith and receiving said projecting end portions of said hinge members within the boundaries thereof, said door having a passageway therein with its axis in alignment with said common axis of said passageways through said end portions of said hinge members and extending continuously from one end of said door and between said spaced hinge members;

d. a torsion rod received within said passageway in said door from said one end thereof and through said passageways of both of said pair of hinge members, said rod being rotatably received in said passageway in said door and said passageway of the one of said pair of hinge members adjacent said one end of said door, said rod being fixedly received against rotation in said passageway of the other of said pair of hinge members; and e. locking means at said one end of said door locking the adjacent portion of said torsion rod against rotation with respect to said door when said torsion rod is received within said passageway in said door and through said passageways of both of said pair of hinge members.

2. A refrigerator door structure as claimed in claim 1 wherein said hinge members each comprise a flat plate rigidly mounted at one of its ends on said mullion and projecting therefrom with the sides of said plate extending in alignment with the length of said mullion, the projecting end portion of said plate forming an offset body with said passageway formed therethrough on one side of said plate.

3. A refrigerator door structure as claimed in claim 2 wherein said mullion comprises a generally U-shape extrusion having a generally flat bottom and said hinge members each include a base member providing flanges along said one end of said flat plate on the opposite sides thereof, said hinge members each being received through a different slot in said generally flat bottom of said mullion with said flanges thereof rigidly fixed to said mullion on opposite sides of said slot.

4. A refrigerator door structure as claimed in claim 3 wherein said offset body generally defines a cube having dimensions smaller than the width of said flat plate.

5. A refrigerator door structure as claimed in claim 2 wherein said side of said door extending overlappingly along said mullion abuts said flat plates of said hinge members when said door is in its closed position with respect to said mullion and is provided with a pair of notches therein each receiving said offset body of a different one of said hinge members.

6. A refrigerator door structure as claimed in claim 1 wherein said passageway of said one of said hinge members adjacent said one end of said door has a circular cross-section, said passageway of said other of said hinge members has a non-circular cross-section and said torsion rod has a shank of non-circular cross-section at one end thereof dimensioned to be matingly received in said passageway of non-circular cross-section and a shank of circular cross-section at the other end thereof dimensioned to be matingly received in said passageway of circular cross-section.

7. A refrigerator door structure as claimed in claim 6 wherein said passageway in said door has a circular cross-section of given diameter, said passageway of circular cross-section has a diameter equal to said given diameter and said passageway of non-circular cross-section has a maximum transverse dimension equal to said given diameter.

8. A refrigerator door structure as claimed in claim 7 wherein said shank of circular cross-section of said torsion rod has a length greater than the length of said passageway of circular cross-section and said shank of non-circular cross-section of said torsion rod has a length greater than the length of said passageway of non-circular cross-section.

9. A refrigerator door structure as claimed in claim 8 wherein said locking means at said one end of said door comprises a keyway formed in said door and a mating key formed in said adjacent portion of said torsion rod.

10. A refrigerator door structure as claimed in claim 9 wherein said door comprises a rectangular metal frame with a rectangular glass panel mounted therein, said rectangular metal frame being constructed of lengths of an extrusion mitered and rigidly joined together at the corners thereof, said extrusion comprising a body which is generally rectangular in cross-section having a lip projecting transversely of said rectangular cross-section from one end thereof for receiving said glass panel thereagainst, a groove formed in the other end of said rectangular cross-section for receiving an elongated sealing member about a face of said rectangular metal frame and a passageway formed therethrough within said rectangular cross-section to provide said passageway in said door at said one side thereof extending overlappingly along said mullion.

11. In a refrigerator door structure for selectively closing a rectangular opening through the wall of a refrigerated compartment having a substantially flat exterior surface defining a substantially vertical plane, said opening being bonded by substantially horizontal upper and lower structural members spaced from each other a given vertical distance, a mullion having an elongated flat surface with a length slightly less than said given vertical distance and mounting means at each of its ends for rigidly fixing said ends of said mullion to said upper and lower structural members with said mullion in a substantially vertical position within said opening, said mullion including projections at the ends thereof for engaging said flat exterior surface of said refrigerator compartment and aligning said flat surface of said mullion therewith in said substantially vertical plane thereof.

12. In a refrigerator door structure, a mullion as claimed in claim 11 wherein said mullion is provided with elongated ridges extending along opposite elongated sides of said flat surface thereof, the ends of said ridges projecting from the ends of said mullion to provide said projections at the ends of said mullion for engaging said flat exterior surface of said refrigerator compartment.

13. In a refrigerator door structure having a mullion as claimed in claim 11, a pair of hinge members rigidly mounted on said mullion and projecting from said flat surface thereof externally of said refrigerator compartment and normally to said substantially vertical plane thereof, each of said pair of hinge members having a passageway through the projecting end thereof with said passageways of said hinge members in coaxial alignment along a given axis parallel to the axis of elongation of said flat surface of said mullion and a torsion rod received through said passageways in said projecting ends of said hinge members along said given axis, said torsion rod being rotatably received in the passageway of one of said pair of hinge members and fixedly received in said passageway of the other of said pair of hinge members.

14. In a refrigerator door structure having a mullion as claimed in claim 11, a rectangular door having sides of greater length than said given vertical distance with one side extending overlappingly along said flat surface of said mullion and hinged thereto for swinging movement about an axis in parallel alignment with the axis of elongation of said flat surface of said mullion from a closed position in which said one side of said door contacts said flat surface of said mullion to an open position.

15. In a refrigerator door structure having a mullion as claimed in claim 14 resilient means acting solely between said mullion and said door urging said door toward said closed position thereof with respect to said mullion.

16. A refrigerator door structure for selectively closing a rectangular opening through the wall of a refrigerated compartment bounded by substantially horizontal upper and lower structural members spaced from each other a given vertical distance, said door structure comprising:

a. a pair of spaced rigid hinge members each having a mounting base and a projecting end portion with a passageway formed therethrough;

b. a rectangular door having sides of greater length than said given vertical distance with one side receiving said projecting end portions of said pair of spaced hinge members within the boundaries thereof, said door having a passageway therein extending continuously from one end of said door along a given rectilinear axis and between said pair of spaced hinge members with said passageways through said projecting ends of said hinge members in coaxial alignment with said given rectilinear axis;

c. a torsion rod received within said passageway in said door from said one end thereof and through said passageways of both of said pair of hinge members, said rod being rotatably received in said passageway in said door and said passageway of the one of said pair of hinge members adjacent said one end of said door, said rod being fixedly received against rotation in said passageway of the other of said pair of hinge members; and d. locking means at said one end of said door locking the adjacent portion of said torsion rod against rotation with respect to said door when said torsion rod is received within said passageway in said door and through said passageways of both of said pair of hinge members.

* * * * *